US007703257B2

(12) United States Patent
Cueli Lopez

(10) Patent No.: US 7,703,257 B2
(45) Date of Patent: Apr. 27, 2010

(54) MOBILE STRUCTURE FOR ADAPTING SURFACES

(76) Inventor: Jorge Tomas Cueli Lopez, C/ La Regata no. 13 Bajo B., Santiago de Cartes (Cantabria) (ES) 39311

( * ) Notice: Subject to any disclaimer, the term of this patent is extended or adjusted under 35 U.S.C. 154(b) by 11 days.

(21) Appl. No.: 12/094,094

(22) PCT Filed: Nov. 7, 2006

(86) PCT No.: PCT/ES2006/000610

§ 371 (c)(1),
(2), (4) Date: May 16, 2008

(87) PCT Pub. No.: WO2007/057483

PCT Pub. Date: May 24, 2007

(65) Prior Publication Data

US 2008/0286037 A1 Nov. 20, 2008

(30) Foreign Application Priority Data

Nov. 18, 2005 (ES) ..... 200502834

(51) Int. Cl.
*E04G 1/20* (2006.01)

(52) U.S. Cl. ..... 52/646; 52/143; 52/126.1; 52/638

(58) Field of Classification Search ..... 52/648.1, 52/649, 649.5, 64, 67, 126.1, 9, 10, 646, 52/638
See application file for complete search history.

(56) References Cited

U.S. PATENT DOCUMENTS 3,222,827 A * 12/1965 Smith ..... 52/9
3,313,080 A * 4/1967 Gewiss ..... 428/593
3,400,502 A * 9/1968 Scaggs et al. ..... 52/9
3,472,728 A * 10/1969 Hitch ..... 428/119
3,488,898 A * 1/1970 Scaggs ..... 52/10
3,748,798 A * 7/1973 Mackintosh ..... 52/10
4,467,569 A * 8/1984 Blanchard et al. ..... 52/9
4,655,022 A 4/1987 Natori et al.
4,791,773 A * 12/1988 Taylor ..... 52/786.13
5,050,353 A * 9/1991 Rogers et al. ..... 52/8
5,152,109 A * 10/1992 Boers ..... 52/143
5,185,972 A * 2/1993 Markiewicz ..... 52/63
5,381,873 A * 1/1995 Kniefel et al. ..... 182/152
5,680,732 A * 10/1997 Skouras ..... 52/126.1
5,701,713 A * 12/1997 Silver ..... 52/645
5,784,835 A * 7/1998 McArthur, Jr. ..... 52/9
5,820,110 A * 10/1998 Beu ..... 256/59
6,044,607 A * 4/2000 Dumlao et al. ..... 52/443
6,598,351 B2 * 7/2003 Hallberg ..... 52/9
6,772,564 B2 * 8/2004 Leon ..... 52/126.5

(Continued)

FOREIGN PATENT DOCUMENTS

DE 2815243 A 10/1979

(Continued)

*Primary Examiner*—Richard E Chilcot, Jr.
*Assistant Examiner*—Alp Akbasli
(74) *Attorney, Agent, or Firm*—Lucas & Mercanti, LLP

(57) ABSTRACT

The invention relates to a mobile structure for adapting surfaces, which is formed by a grid assembly (1) which is supported at grid nodes by telescopic columns (2) which can be individually extended in order to use the grid assembly (1) to form a variable surface comprising relief elements.

4 Claims, 7 Drawing Sheets

U.S. PATENT DOCUMENTS

| | | | | |
|---|---|---|---|---|
| 7,093,888 | B2 * | 8/2006 | Anderson et al. | 296/162 |
| 2001/0002964 | A1 | 6/2001 | Song et al. | |
| 2003/0051420 | A1 * | 3/2003 | Leon | 52/126.6 |
| 2003/0196402 | A1 * | 10/2003 | Roen | 52/507 |
| 2004/0163695 | A1 | 8/2004 | Carter et al. | |

FOREIGN PATENT DOCUMENTS

| | | |
|---|---|---|
| EP | 0305183 XA | 3/1989 |
| JP | 2000008479 Z | 1/2000 |
| WO | 9313284 XA | 7/1993 |

* cited by examiner

MOBILE STRUCTURE FOR ADAPTING SURFACES

FIELD OF THE ART

The present invention relates to the configuration of relief surfaces, proposing a mobile support structure which allows selectively adapting and modifying the orography of large surfaces as desired.

STATE OF THE ART

There are constructive surface applications in which the orographic shape can have a special interest, support structures and/or variable fillings with construction materials conventionally being used for such purpose for determining the configurative reliefs of the different parts on the corresponding surfaces.

This conventional technique implies a constructive implementation virtually requiring sculpture work, determining fixed constructions, the modification of which generally forces a destruction or reconstruction of the interested parts, with the work, time and cost which this implies.

OBJECT OF THE INVENTION

According to the invention a structure is proposed which is developed according to constructive and functional features, which allow supporting surfaces in adaptation conditions for selectively forming the desired orography.

This structure object of the invention consists of a modular grid assembly which is supported with respect to the grid nodes by means of telescopic columns, the grid structure being formed by telescopic, longitudinal, transverse and diagonal ties, which are attached in a hinged manner on cores determining the grid nodes.

The ties of the modular grid assembly consist of a free telescopic formation between the component elements, insofar as the support columns individually have an actuation system for actuating the extension and retraction of the telescopic formation thereof. The actuation system of the telescopic columns, for such purpose, can be any type of those known in the current art, such as for example hydraulic, mechanical, electrical, etc., without this altering the concept.

A structural assembly is therefore obtained whereby, by means of the selective extension of the different support columns, a variable orographic surface configuration can be formed with the grid assembly, based on the different elevation of the multiple grid nodes, which can be automatically controlled by computer management depending on a programming corresponding with the shape to be made.

The dimension of the modular parts of the grid assembly can be variable, where appropriate, depending on the extension of the surface to be formed and on the detail of the shapes desired in the configuration.

The mentioned structural assembly is complemented with a covering determining the desired surface, which is formed on a support mat which is arranged on the grid assembly of the adaptable structure, said mat being formed according to an undulated formation in four directions, allowing to absorb the dimensional variations of the grid assembly in the different directions when the structure is adapted to the application surface shapes.

The gaps of the grid assembly are closed with sheet plates or the like, by means of which a continuous support for the undulated mat of the covering is determined, said plates being arranged according to a practical non-limiting solution, in a hinged attachment on diagonal ties of the grid assembly and supported with freedom to slide on telescopic crosspieces incorporated in the area of the vertex opposite the respective diagonal tie, which likewise allows absorbing the dimensional variations of the grid assembly in the adaptation of the structure to the application shapes.

The proposed structure therefore allows adapting the orographic configuration of any surface in a very simple manner, regardless of the dimensions and application, with the possibility of later modifying the formed surface with the same ease for its adaptation to other different shapes. In such conditions the structure can be applied both for horizontal surfaces and for vertical surfaces, allowing to adapt the orographic shape of floors and of walls.

Due to the above, said structure object of the invention has truly advantageous features, acquiring its own identity and a preferable character in the function for which it is intended.

DETAILED DESCRIPTION OF THE INVENTION

The object of the invention relates to a support structure intended for forming floor or wall surfaces, said structure comprising a constructive formation allowing an adaptation movement in order to configure the desired orographic shape of any surface.

Figure 1:
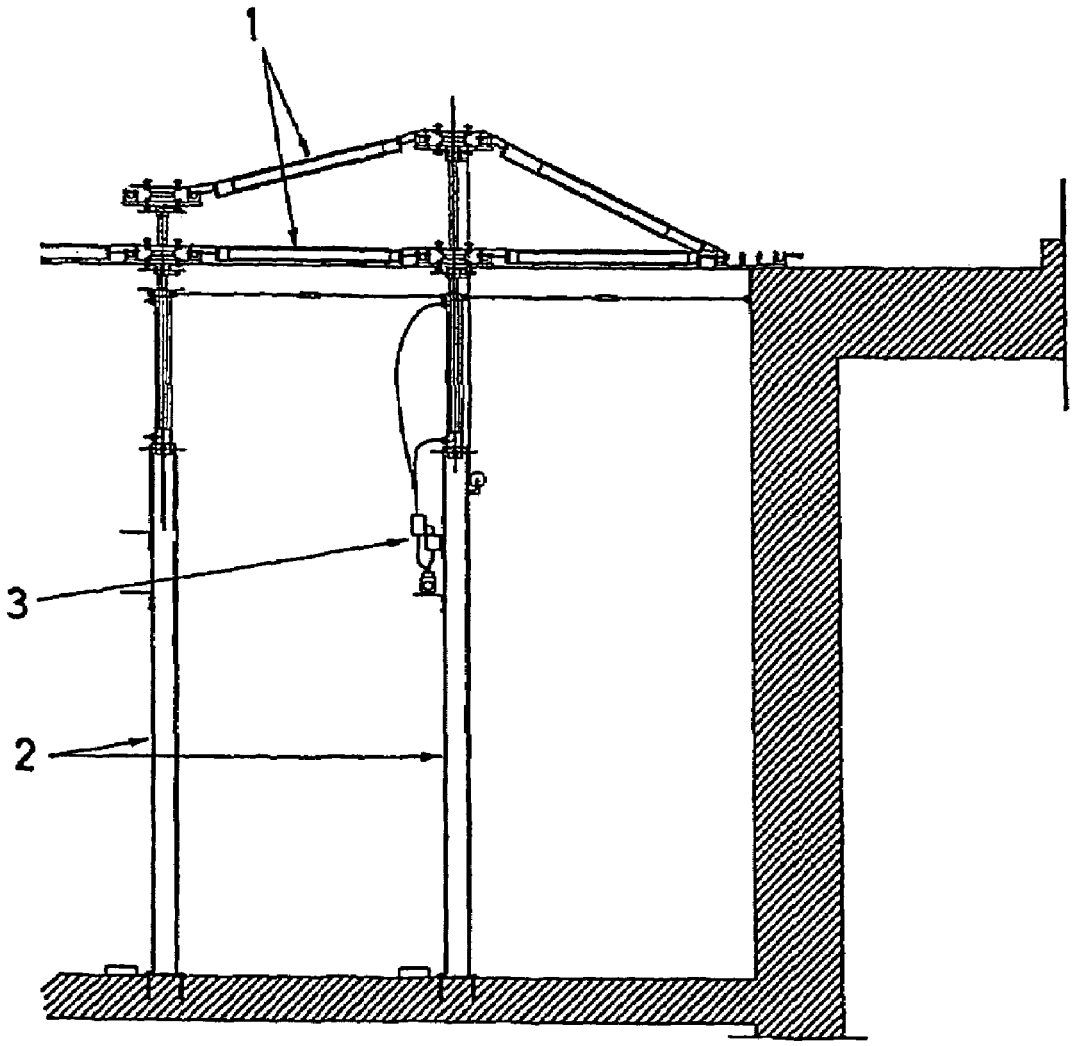
FIG. 1 shows a partial assembly of the mounting of an adaptable structure according to the invention, with the grid assembly in two different height positions.
Figure 2:
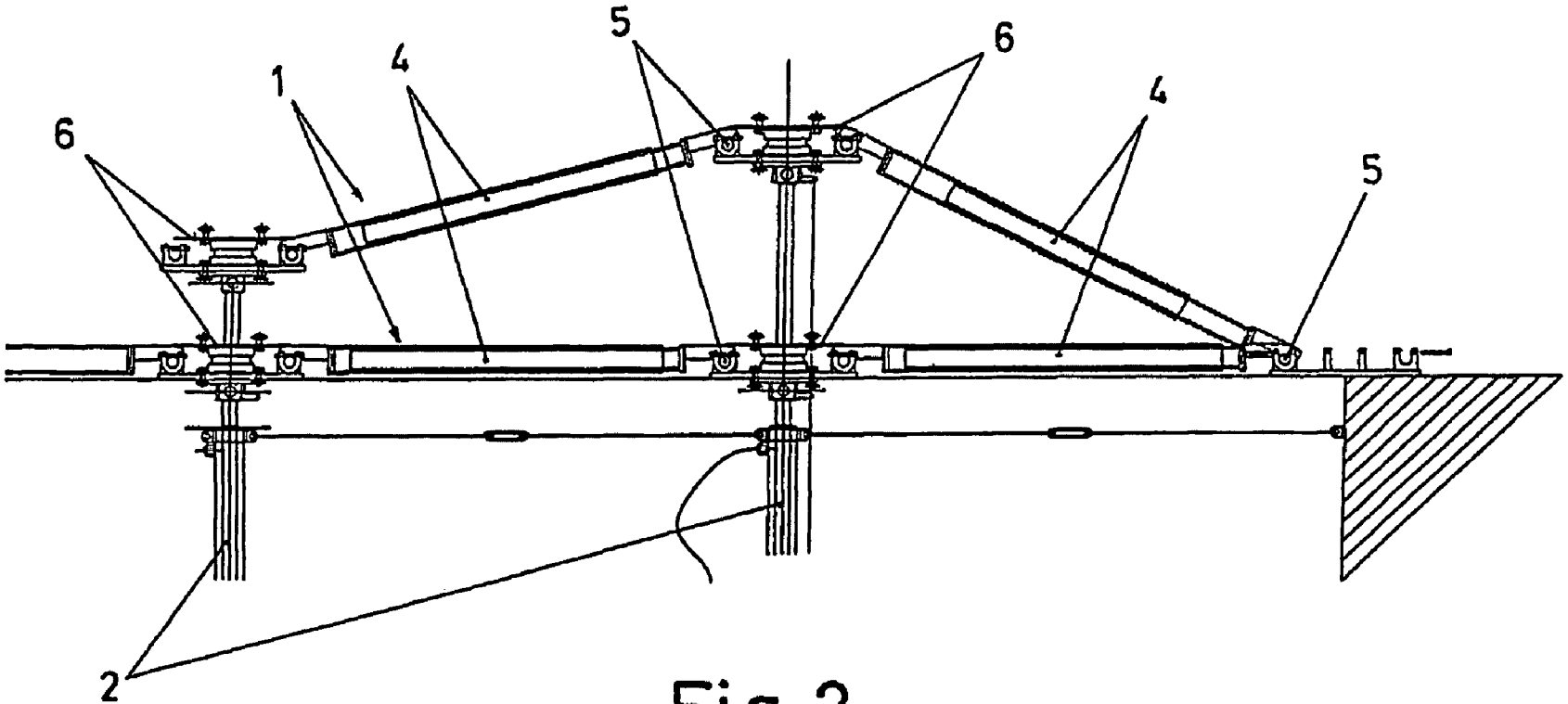
FIG. 2 is an enlarged detail of the upper part of the previous structure.

The structure comprises (FIGS. 1 and 2) a grid assembly (1), which is supported with respect to the grid nodes by means of respective telescopic columns (2) having an individual actuation system (3) for extending their length.

Figure 3:
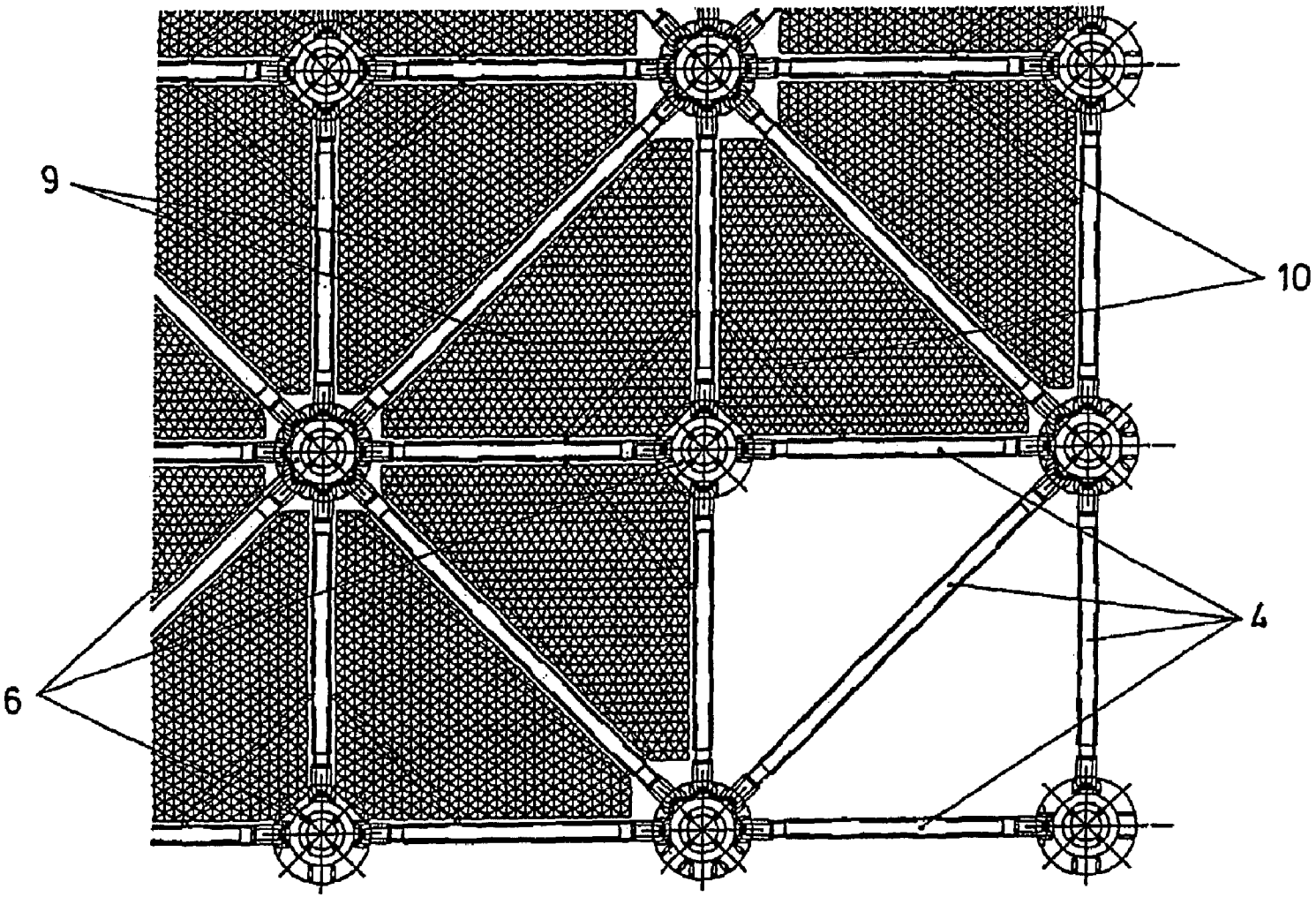
FIG. 3 is a plan view of the grid assembly of the adaptable structure.
Figure 4:
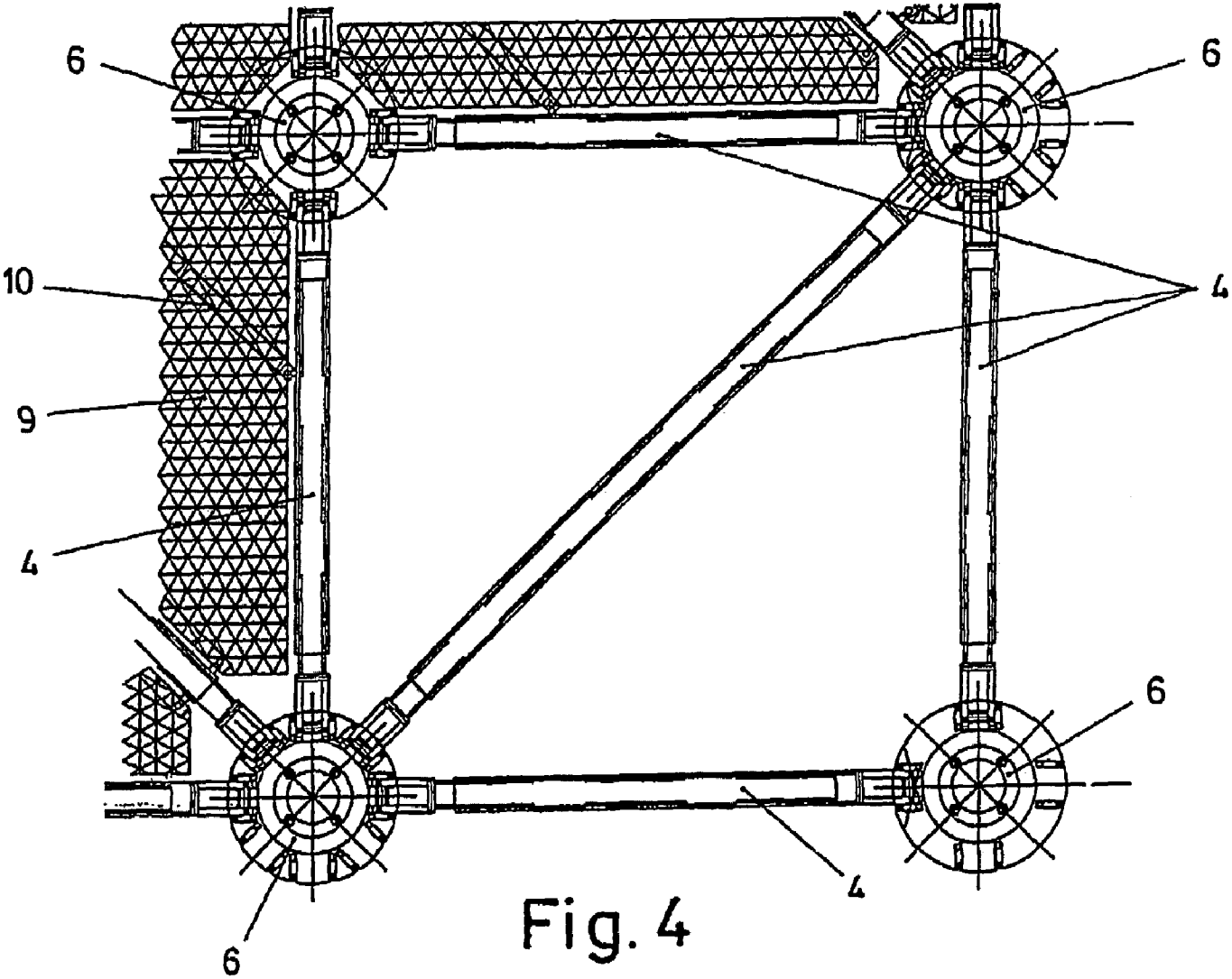
FIG. 4 is an enlarged partial detail of one part of the mentioned grid assembly of the structure.
Figure 5:
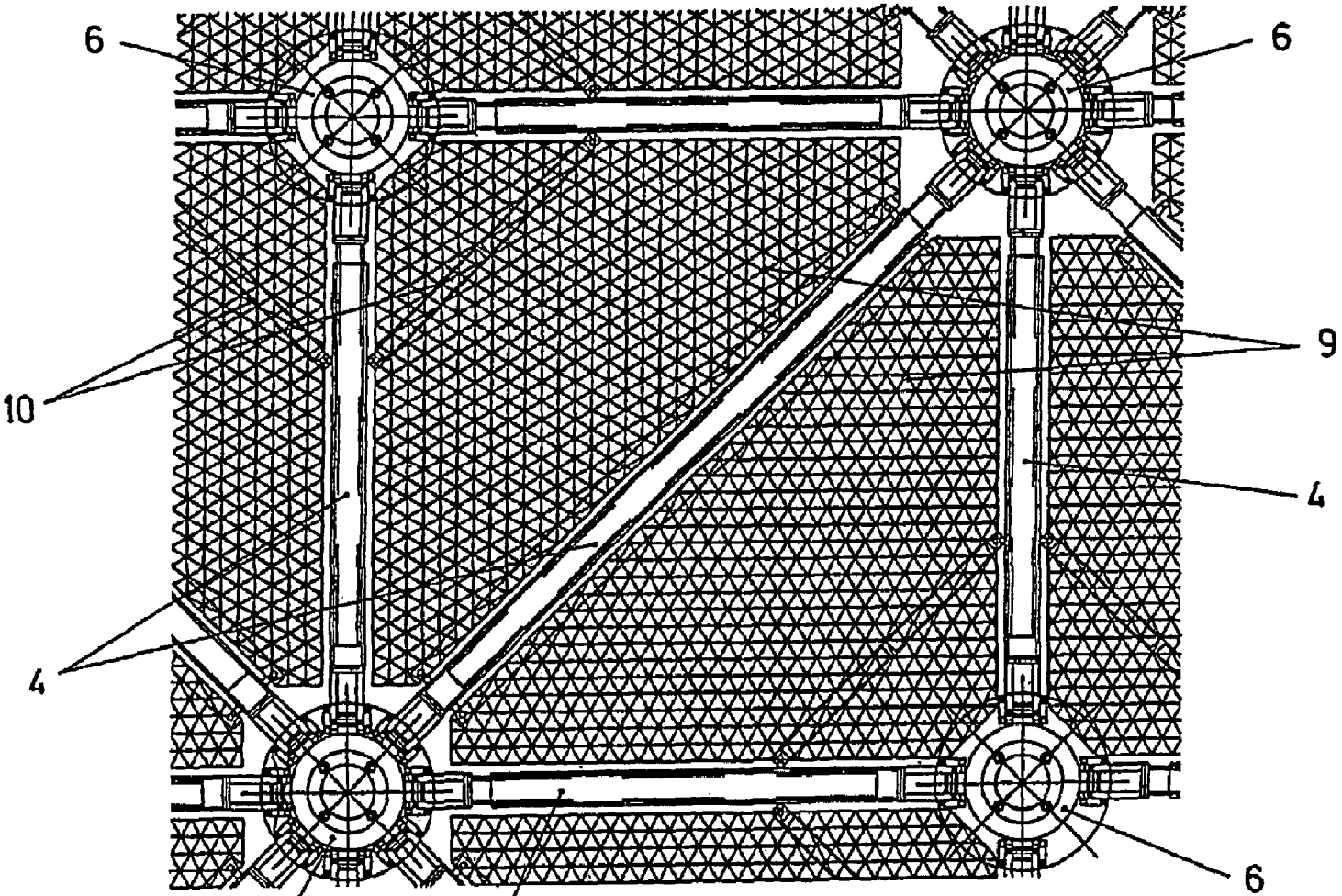
FIG. 5 is an enlarged detail of the grid assembly of the structure with the covering closure of the grid gaps.

The grid assembly (1) (FIGS. 3, 4 and 5) consists of a modular composition formed by longitudinal, transverse and diagonal ties (4), which are attached by means of hinges (5) on cores (6) forming the grid nodes, the mentioned ties (4) being structured according to a freely extending telescopic formation.

The grid assembly (1) can therefore be adapted as a surface extension, such that by means of longitudinally extending the columns (2), the cores (6) can be placed at different heights, allowing to configure with the mentioned grid assembly (1) variable shapes of a relief surface.

Figure 6:
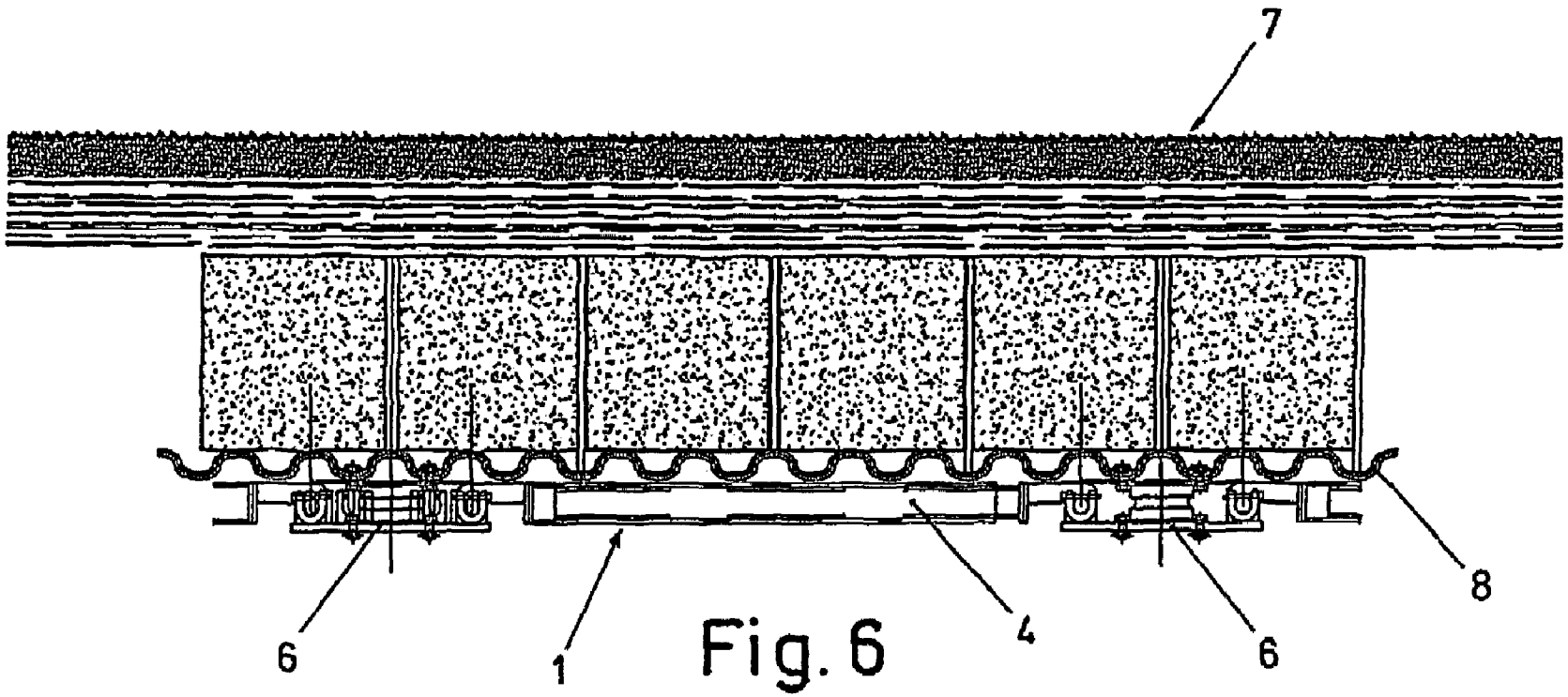
FIG. 6 is a sectional detail of the mounting of an application covering on the proposed adaptable structure.

A covering (7), based on different materials and layers, can be placed on the mentioned structural assembly (FIG. 6) allowing to form a surface with the desired appearance and characteristics for any application.

Figure 7:
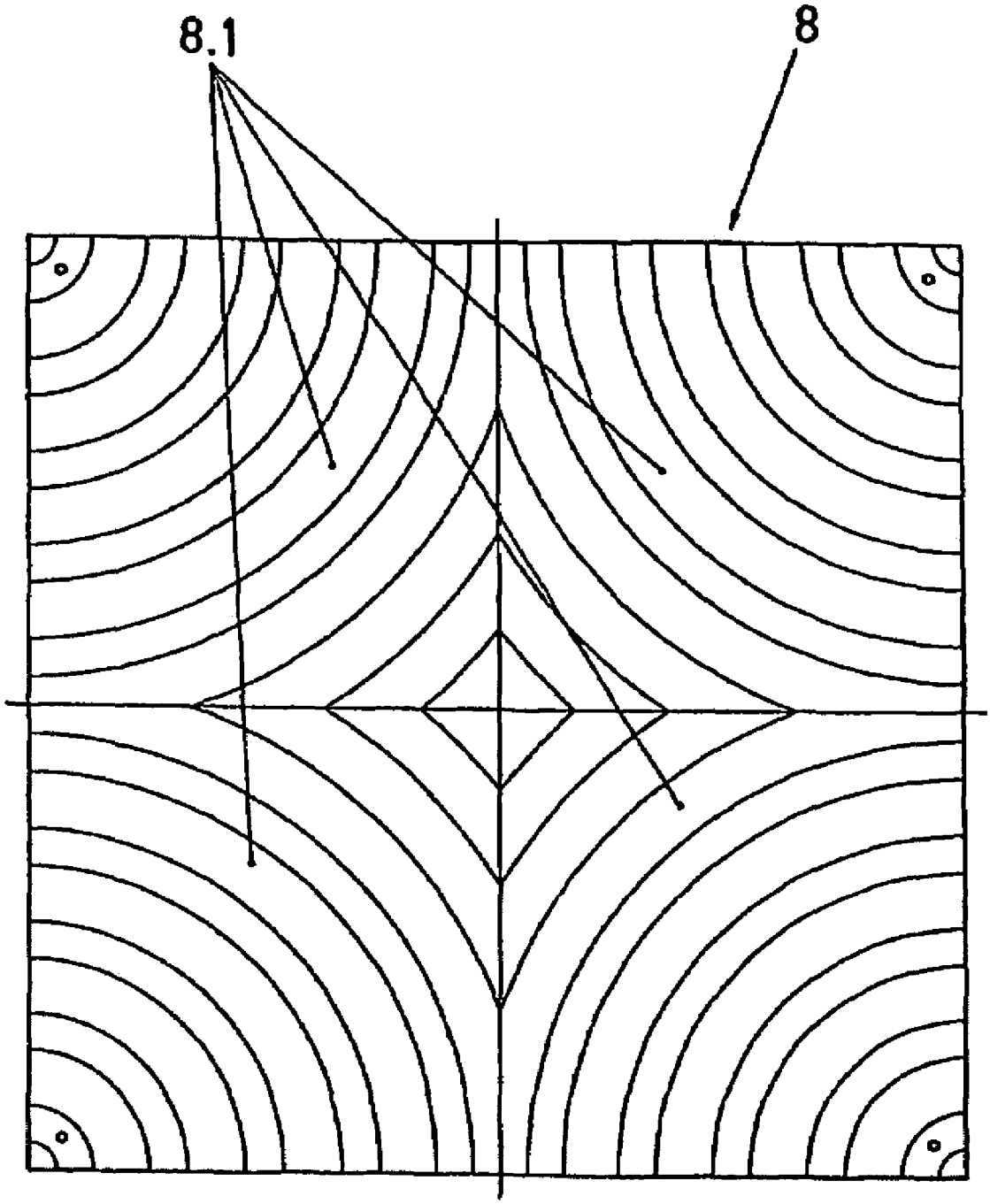
FIG. 7 is a plan detail of a modular part of the undulated mat which is used for supporting the application covering on the adaptable structure.

According to a practical embodiment the covering (7) is arranged on a support mat (8), which is placed on the grid assembly (1), said mat (8) being structured with an undulated formation (8.1) in four directions, as shown in FIG. 7, such that it allows absorbing without stress the dimensional variations of the grid assembly (1) in the adaptation to the shapes of the application surfaces of the structure.

The gaps of said grid assembly (1) are covered with corresponding sheet plates (9) or the like for the uniform support of the mat (8) on the grid assembly (1), which plates, according to a practical embodiment, (FIGS. 3 and 5), are arranged in a hinged attachment on diagonal ties (4) of the mentioned grid assembly (1), and are supported with freedom to slide on telescopic crosspieces (10) arranged in the areas with the corresponding opposite vertices.

This arrangement of the closure of the gaps of the grid assembly (1) is non-limiting, and can be any other arrangement with the same effect in which the closing plates (9) are secured in the mounting, allowing the dimensional variation of the gaps of the grid assembly (1), such that the hinged attachment for securing said plates (9) can be provided on any of the sides there of, on the corresponding tie (4) of the grid assembly (1), whereas the other two sides are free to slide.

The modular formation of the grid assembly (1) of the proposed structure can be formed with modular parts of any dimension where appropriate, according to the extension and the shapes of the surfaces to be formed, such that the smaller the dimension of the modular parts forming said grid assembly (1), the greater the capacity of adaptation to complex shapes and with greater detail of the application surfaces.

The actuation system (3) for extending the telescopic columns (2) is individual for each of the columns (2), said actuation system (3) being able to be of any type (hydraulic, mechanical, electrical, etc.) of the known techniques, the entire assembly being controlled by a computer control means such that based on data programming in said control means, according to the shapes of the surface to be configured, the structure for forming the application surface is automatically adapted, which can subsequently be also transformed into other shapes with the entry of data corresponding to the new shape into the control means.

What is claimed is:

1. A mobile structure for forming a surface comprising:

a grid assembly, arranged on telescopic columns supporting the grid assembly, one end of each of the telescopic columns forming a grid node, the telescopic columns individually extendable in order to place each grip node of the grid assembly at different heights;

telescoping ties interconnect each grid node;

grid gaps formed between the ties and delimited by the ties;

telescoping cross pieces, one of each of the cross pieces extends between and connected to two adjacent ties in each of the grid gaps;

plates closing grid gaps arranged in the grid assembly for supporting a covering determining the surface to be formed, each of the plates secured in a hinged manner at an edge to one of the ties in one of the grid gaps, the one of the ties opposite the one of the cross pieces in each of the grid gaps, and each of the plates arranged freely sliding on the one of the cross pieces, allowing the dimensional variation of the grid assembly in the adaptation to the shapes of the surfaces.

2. The mobile structure according to claim 1, wherein the grid assembly has a modular composition formed by the ties which are arranged longitudinal, transverse and diagonal between each grid node and the ties being attached by means of hinges to each grid node.

3. The mobile structure according to claim 1, wherein the telescopic columns each have an extension actuation system, said actuation system being automatically controlled by a computer means determining the particular extension of each of the columns in order to place each grid node of the grid assembly at the corresponding heights according to the surface to be formed.

4. The mobile structure according to claim 1, wherein the covering is arranged on the grid assembly by means of a support mat, which is structured with undulations in four directions, allowing to absorb the dimensional variations of the grid assembly in the adaptation to shapes of the surfaces to be formed.

* * * * *